United States Patent [19]

Kanda et al.

[11] Patent Number: 4,794,101

[45] Date of Patent: Dec. 27, 1988

[54] HEAT-SENSITIVE RECORDING MATERIAL

[75] Inventors: Nobuo Kanda, Hirakata; Kimie Tsuboi, Shizuoka; Fumio Seyama, Osaka; Mitsuru Kondo, Hyogo, all of Japan

[73] Assignee: Kanzaki Paper Manufacturing Co., Ltd., Tokyo, Japan

[21] Appl. No.: 59,746

[22] Filed: Jun. 8, 1987

[30] Foreign Application Priority Data

Jun. 17, 1986 [JP] Japan ..... 61-142277

[51] Int. Cl.[4] ..... B41M 5/18

[52] U.S. Cl. ..... 503/208; 427/151; 428/913; 503/209; 503/210; 503/211; 503/212; 503/216; 503/217; 503/220; 503/221; 503/223

[58] Field of Search ..... 427/151; 503/208, 209, 503/216–218, 220, 221, 223, 225, 210–212; 428/913

[56] References Cited

U.S. PATENT DOCUMENTS 4,658,276 4/1987 Kanda et al. ..... 503/220

*Primary Examiner*—Bruce H. Hess

*Attorney, Agent, or Firm*—Armstrong, Nikaido, Marmelstein & Kubovcik

[57] ABSTRACT

In a heat-sensitive recording material incorporating a colorless or pale-colored basic dye and a color acceptor which is reactive with the dye to form a color when contacted therewith, the recording material characterized in that (a) as the basic dye are used 100 parts by weight of a specific phthalide derivative of the formula [I] and 20 to 100 parts by weight of a specific black color-forming fluoran derivative of the formula [II], (b) as the color acceptor is used a polyvalent metal salt of an aromatic carboxylic acid and (c) a recording sensitizer is further used, and whereby the resulting record images are at least 0.75 in PCS value at 800 nm.

10 Claims, No Drawings

HEAT-SENSITIVE RECORDING MATERIAL

The present invention relates to a black color-forming heat-sensitive recording material which has outstanding characteristics for use with optical character- or mark-reading devices having a reading wavelength range over the infrared region.

A heat-sensitive recording material comprises a recording layer formed on a paper, sythetic paper or like substrate, the recording layer containing a colorless or pale-colored basic dye and a color acceptor as main components and capable of forming a color with heat. The recording material forms record images by heating with a thermal head, thermal pen, etc., and is presently widely used as a recording medium for use with a facsimile, printer, electrocardiography in greatly increasing amounts.

With a trend toward more efficient office work, optical character-reading devices having a reading wavelength range over the infrared region are in greatly increasing use for reading the record images on record media. However, conventional basic dyes form record images which have not light absorbency over near infrared region of 700 to 900 nm, hence inapplicable to the above use.

Therefore, the later-mentioned phthalide derivatives of the formula [I] having a fluorene skeleton have been developed as dyes suitable to the above use. These phthalide derivatives react with a color acceptor to form light-blue images having light absorbency over near infrared region of 700 to 900 nm, which are readable by the optical character-reading device.

However, the phthalide derivatives of the formula [I] form light-blue images as mentioned above by the reaction with a phenolic compound and like organic color acceptor, and the images are low in color density. Thus, the recording material using the above phthalide derivative has poor commercial value as a heat-sensitive recording material in which clear black-colored images are required.

In view of the above, it is considered to use the phthalide derivative of the formula [I] conjointly with the later-mentioned black color-forming fluoran compound of the formula [II], but the phthalide derivative is suppressed in color forming ability by the conjoint use due to unknown reasons. As the result are obtained images having low PCS value [(reflectivity of the background area before recording)-(reflectivity of the recorded area after recording)/(reflectivity of the background area before recording)], and the images are readable by only a limited optical character-reading device in which images having low PCS value can be read. Further, images formed with use of a conventional phenolic color acceptor have a defect to easily fade by the irradiation of sunlight or fluorescent lamp.

An object of the invention is to provide a heat-sensitive recording material capable of forming clear black-colored images which are readable by various optical character-rading devices having a reading wavelength range over near infrared region and are excellent in stability against irradiation of light.

The above and other objects of the invention will become apparent from the following description.

In a heat-sensitive recording material incorporating a colorless or pale-colored basic dye and a color acceptor which is reactive with the dye to form a color when contacted therewith, the present invention provides a recording material characterized in that (a) as the basic dye are used 100 parts by weight of a phthalide derivative of the formula [I] and 20 to 100 parts by weight of a black color-forming fluoran derivative of the formula [II], (b) as the color acceptor is used a polyvalent metal salt of an aromatic carboxylic acid and (c) a recording sensitizer is further used, and whereby the resulting record images are at least 0.75 in PCS value at 800 nm

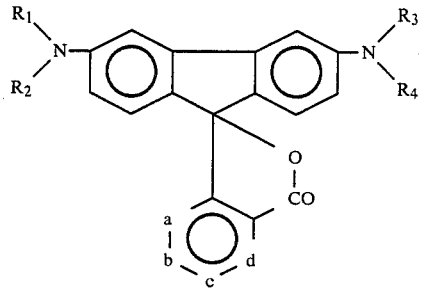

[I]

wherein $R_1$ to $R_4$ are each hydrogen atom; $C_{1\sim8}$ alkyl; $C_{5\sim8}$ cycloalkyl; $C_{3\sim8}$ alkoxyalkyl; $C_{3\sim9}$ unsaturated alkyl; tetrahydrofurfuryl; tetrahydropyran-2-methyl; $C_{7\sim10}$ aralkyl unsubstituted or substituted with halogen atom, $C_{1\sim4}$ alkyl or $C_{1\sim4}$ alkoxyl; phenyl unsubstituted or substituted with halogen atom, $C_{1\sim4}$ alkyl or $C_{1\sim4}$ alkoxyl; $C_{2\sim8}$ alkyl having phenoxy unsubstituted or substituted with halogen atom, $C_{1\sim4}$ alkyl or $C_{1\sim4}$ alkoxyl; or halogenated $C_{1\sim8}$ alkyl; $R_1$ and $R_2$, and/or $R_3$ and $R_4$ may form a heteroring selected from the group consisting of pyrrolidine, piperidine, hexamethyleneimine, morpholine, julolidine and tetrahydroquinoline together therewith or with an adjacent benzene ring, a, b, c and d represent carbon atoms and one or two of them may be nitrogen atom, the carbon atom may have a substituent selected from the group consisting of hydrogen atom; halogen atom; $C_{1\sim4}$ alkyl; $C_{1\sim4}$ alkoxyl; —$N(R_5)(R_6)$, $R_5$ and $R_6$ are same as $R_1$ to $R_4$; and nitro, one of a—b, b—c and c—d bond may form an another benzene ring together with the substituent,

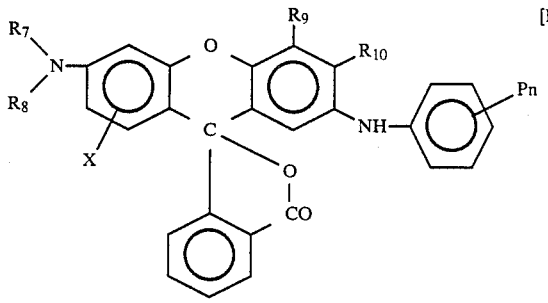

[II]

wherein $R_7$ and $R_8$ are each $C_{1\sim8}$ alkyl unsubstituted or substituted with halogen atom or $C_{1\sim4}$ alkoxyl; unsaturated $C_{3\sim9}$ alkyl; $C_{5\sim12}$ alicyclic group; phenyl unsubstituted or substituted with halogen atom, $C_{1\sim4}$ alkyl or $C_{1\sim4}$ alkoxyl; benzyl unsubstituted or substituted with halogen atom, $C_{1\sim4}$ alkyl or $C_{1\sim4}$ alkoxyl; or tetrahydrofurfuryl, $R_7$ and $R_8$ may form a ring selected from the group consisting of pyrrolidine, piperidine, hexamethyleneimine and morpholine together therewith, $R_9$ and $R_{10}$ are each hydrogen atom; halogen atom; $C_{1\sim4}$ alkyl; or $C_{1\sim4}$ alkoxy, P is hydrogen atom; halogen atom; $C_{1\sim4}$ alkyl; $C_{5\sim6}$ alicyclic group; halogenated $C_{1\sim4}$ alkyl; phenyl; benzyl; $C_{1\sim4}$ alkoxy; ($C_{1\sim4}$ alkoxy)-carbonyl; or di($C_{1\sim4}$ alkyl)amino, X is hydrogen atom; halogen atom; or $C_{1\sim4}$ alkyl, n is an integer of 1 to 4.

In the present heat-sensitive recording material, specific phthalide derivative and black color-forming fluoran derivative are conjointly used as basic dyes in specific proportions, a polyvalent metal salt of aromatic carboxylic acid is used as a color acceptor and further a recording sensitizer is used to form clear black-colored images without lowering color forming ability of the phthalide derivative and with excellent recording sensitivity. The resulting images are highly improved in preservability, especially in light resistance, do not fade by the irradiation of light and exhibit stable light absorbency over infrared region of 700 to 900 nm. Consequently, the present heat-sensitive recording material has also an advantage of being applicable to the optical character-reading device having a reading wavelength over the visible region.

Examples of phthalide derivatives of the formula [I] used in the invention are as follows:

3-Dimethylamino-6-(N-ethyl-N-ethoxyethylamino)-fluorene-9-spiro-3'-(6'-dimethylamino)phthalide,
3-Dimethylamino-6-(N-ethyl-N-methoxyethylamino)-fluorene-9-spiro-3'-(6'-dimethylamino)phthalide,
3-Di-n-butylamino-6-(N-methyl-N-methoxyethylamino)fluorene-9-spiro-3'-(6'-dimethylamino)phthalide,
3-Pyrrolidino-6-(N-ethyl-N-ethoxyethylamino)fluorene-9-spiro-3'-(6'-pyrrolidino)phthalide,
3-(N-Methyl-N-cyclohexylamino)-6-(N-ethyl-N-ethoxyethylamino)fluorene-9-spiro-3'-(6'-dimethylamino)phthalide,
3-Diethylamino-6-(N-methyl-N-allylamino)fluorene-9-spiro-3'-(6'-dimethylamino)phthalide,
3-Dimethylamino-6-(diallylamino)fluorene-9-spiro-3'-(6'-dimethylamino)phthalide,
3-Di-n-butylamino-6-(N-methyl-N-allylamino)fluorene-9-spiro-3'-(6'-dimethylamino)phthalide,
3-Pyrrolidino-6-(N-ethyl-N-2-butenylamino)fluorene-9-spiro-3'-(6'-dimethylamino)phthalide,
3-(N-Methyl-N-cyclohexylamino)-6-(N-ethyl-N-propargylamino)fluorene-9-spiro-3'-(6'-dimethylamino)phthalide,
3-Dimethylamino-6-(N-methyl-N-tetrahydrofurfurylamino)fluorene-9-spiro-3'-(6'-dimethylamino)phthalide,
3-Diethylamino-6-(N-ethyl-N-cyclopentylamino)fluorene-9-spiro-3'-(6'-dimethylamino)phthalide,
3-Diethylamino-6-(N-ethyl-N-tetrahydrofurylamino)-fluorene-9-spiro-3'-(6'-dimethylamino)phthalide,
3-Diethylamino-6-(N-methyl-N-tetrahydrofurfurylamino)fluorene-9-spiro-3'-(6'-dimethylamino)phthalide,
3-Di-n-propylamino-6-(N-methyl-N-tetrahydrofurfurylamino)fluorene-9-spiro-3'-(6'-dimethylamino)phthalide,
3-Morpholino-6-(N-butyl-N-tetrahydrofurfurylamino)-fluorene-9-spiro-3'-(6'-pyrrolidino)phthalide,
3-(N-Ethyl-N-cyclopentylamino)-6-(N-ethyl-N-tetrahydropyran-2-methylamino)fluorene-9-spiro-3'-(6'-dimethylamino)phthalide,
3-Dimethylamino-6-(N-ethyl-N-β-phenylethylamino)-fluorene-9-spiro-3'-(6'-dimethylamino)phthalide,
3-Diethylamino-6-(N-methyl-N-α-phenylethylamino)-fluorene-9-spiro-3'-(6'-dimethylamino)phthalide,
3-Diethylamino-6-(N-ethyl-N-p-chlorobenzylamino)-fluorene-9-spiro-3'-(6'-dimethylamino)phthalide,
3-Pyrrolidino-6-(N-butyl-N-β-phenylethylamino)fluorene-9-spiro-3'-(6'-morpholino)phthalide,
3-(N-Octyl-N-methylamino)-6-(N-methyl-N-α-phenylethylamino)fluorene-9-spiro-3'-(6'-dimethylamino)phthalide,
3-Dimethylamino-6-(N-methyl-N-phenoxyethylamino)-fluorene-9-spiro-3'-(6'-dimethylamino)phthalide,
3-Diethylamino-6-(N-methyl-N-phenoxyethylamino)-fluorene-9-spiro-3'-(6'-dimethylamino)phthalide,
3-Di-n-butylamino-6-(N-ethyl-N-p-methoxyphenoxyethylamino)fluorene-9-spiro-3'-(6'-diethylamino)phthalide,
3-Pyrrolidino-6-(N-butyl-N-p-chlorophenoxypropylamino)fluorene-9-spiro-3'-(6'-pyrrolidino)phthalide,
3-(N-methyl-N-cyclohexylamino)-6-(N-methyl-N-p-methylphenoxyethylamino)fluorene-9-spiro-3'-(6'-dimethylamino)phthalide,
3-Dimethylamino-6-(N-methyl-N-2-chloroethylamino)-fluorene-9-spiro-3'-(6'-dimethylamino)phthalide,
3-Dimethylamino-6-(N-methyl-N-bromoethylamino)-fluorene-9-spiro-3'-(6'-dimethylamino)phthalide,
3-Dimethylamino-6-(N-methyl-N-methoxyethylamino)fluorene-9-spiro-3'-(6'-dimethylamino)phthalide,
3-Dimethylamino-6-(N-methyl-N-β-phenylethylamino)fluorene-9-spiro-3'-(6'-dimethylamino)phthalide,
3-Diethylamino-6-(N-ethyl-N-β-phenylethylamino)-fluorene-9-spiro-3'-(6'-dimethylamino)phthalide,
3-Dimethylamino-6-(N-ethyl-N-furfurylamino)fluorene-9-spiro-3'-(6'-dimethylamino)phthalide,
3-Dimethylamino-6-(N-methyl-N-o-chlorobenzylamino)fluorene-9-spiro-3'-(6'-dimethylamino)phthalide,
3-Dimethylamino-6-(N-methyl-N-allylamino)fluorene-9-spiro-3'-(6'-dimethylamino)phthalide,
3-Dimethylamino-6-(N-methyl-N-2-butenylamino)fluorene-9-spiro-3'-(6'-dimethylamino)phthalide,
3-Diethylamino-6-(N-methyl-N-methoxyethylamino)-fluorene-9-spiro-3'-(6'-dimethylamino)phthalide,
3-Diethylamino-6-(N-ethyl-N-ethoxyethylamino)fluorene-9-spiro-3'-(6'-dimethylamino)phthalide,
3-Diethylamino-6-dimethylaminofluorene-9-spiro-3'-(6'-dimethylamino)phthalide,
3,6-Bis(dimethylamino)fluorene-9-spiro-3'-(6'-dimethylamino)phthalide,
3-Dibutylamino-6-dimethylaminoflurene-9-spiro-3'-(6'-dimethylamino)phthalide,
3-Dibutylamino-6-diethylaminofluorene-9-spiro-3'-(6'-dimethylamino)phthalide,
3,6-Bis(dimethylamino)fluorene-9-spiro-3'-(6'-diethylamino)phthalide,
3-Diethylamino-6-dimethylaminofluorene-9-spiro-3'-(6'-diethylamino)phthalide,
3-Dibutylamino-6-dimethylaminofluorene-9-spiro-3'-(6'-diethylamino)phthalide,
3,6-Bis(diethylamino)fluorene-9-spiro-3'-(6'-diethylamino)phthalide,
3-Dibutylamino-6-diethylaminofluorene-9-spiro-3'-(6'-diethylamino)phthalide,
3,6-Bis(dimethylamino)fluorene-9-spiro-3'-(6'-dibutylamino)phthalide,
3,6-Bis(diethylamino)fluorene-9-spiro-3'-(6'-pyrrolidino)phthalide, 3,6-Bis(N-ethyl-N-ethoxyethylamino)fluorene-9-spiro-3'-(6'-diethylamino)phthalide,
3-Diethylamino-6-dimethylaminofluorene-9-spiro-3'-(6'-dibutylamino)phthalide,
3-Dimethylamino-6-methylaminofluorene-9-spiro-3'-(6'-dimethylamino)phthalide,
3-Dimethylamino-6-dibenzylaminofluorene-9-spiro-3'-(6'-dimethylamino)phthalide,
3-Pyrrolidino-6-dimethylaminofluorene-9-spiro-3'-(6'-dimethylamino)phthalide,
3-Piperidino-6-dimethylaminofluorene-9-spiro-3'-(6'-dimethylamino)phthalide,
3-Dimethylamino-6-(N-methyl-N-cyclohexylamino)-fluorene-9-spiro-3'-(6'-dimethylamino)phthalide,
3,6-Bis(dimethylamino)fluorene-9-spiro-3'-(4'-aza)phthalide,
3,6-Bis(dimethylamino)fluorene-9-spiro-3'-(7'-aza)phthalide,
3,6-Bis(dimethylamino)fluorene-9-spiro-3'-(4',7'-diaza)phthalide,
3,6-Bis(dimethylamino)fluorene-9-spiro-3'-(4'-aza-5',6'-benzo)phthalide,
3,6-Bis(dimethylamino)fluorene-9-spiro-3'-(7'-aza-5',6'-benzo)phthalide, etc.

These phthalide derivatives can be used singly or in mixture of at least two of them.

Examples of black color-forming fluoran derivatives of the formula [II] of the invention conjointly used with the above phthalide derivative are as follows:

3-Diethylamino-6-methyl-7-anilinofluoran, 3-diethylamino-6-methyl-7-toluidinofluoran, 3-diethylamino-6-methyl-7-xylidinofluoran, 3-diethylamino-6-methyl-7-mesidinofluoran, 3-diethylamino-6-methyl-7-(ρ-butylanilino)fluoran, 3-diethylamino-6-methyl-7-anisidinofluoran, 3-diethylamino-6-methyl-7-ρ-phenetidinofluoran, 3-dimethylamino-6-methyl-7-anilinofluoran, 3-dipropylamino-6-methyl-7-anilinofluoran, 3-di(β-ethoxyethyl)amino-6-methyl-7-anilinofluoran, 3-di(chloroethyl)amino-6-methyl-7-anilinofluoran, 3-dibenzylamino-6-methyl-7-anilinofluoran, 3-(N-cyclohexyl-N-methylamino)-6-methyl-7-anilinofluoran, 3-N-allyl-N-n-pentylamino-6-methyl-7-anilinofluoran, 3-pyrrolidino-6-methyl-7-anilinofluoran, 3-piperidino-6-methyl-7-anilinofluoran, 3-piperidino-6-methyl-7-toluidinofluoran, 3-piperidino-6-methyl-7-(p-butylanilino)fluoran, 3-methylpiperidino-6-methyl-7-(p-butylanilino)fluoran, 3-morpholino-6-methyl-7-(p-butylanilino)fluoran, 3-(N-methyl-anilino)-6-methyl-7-anilinofluoran, 3-(N-ethyl-anilino)-6-methyl-7-anilinofluoran, 3-(N-benzyl-anilino)-6-methyl-7-anilinofluoran, 3-(N-ethyl-p-toluidino)-6-methyl-7-anilinofluoran, 3-(N-ethyl-p-chloroanilino)-6-methyl-7-anilinofluoran, 3-(N-ethylanilino)-6-methyl-7-(p-toluidino)fluoran, 3-(N-ethyl-p-toluidino)-6-methyl-7-(p-toluidino)fluoran, 3-(N-benzylxylidino)-6-methyl-7-(p-toluidino)fluoran, 3-(N-chloroethyl-p-toluidino)-6-methyl-7-xylidino-fluoran, 3-(N-ethyl-anilino)-6-methyl-7-(p-butyl-anilino)-fluoran, 3-dibutylamino-6-methyl-7-anilinofluoran, 3-(N-methyl-N-propylamino)-6-methyl-7-anilinofluoran, 3-(N-ethyl-N-isopentylamino)-6-methyl-7-anilinofluoran, 3-(N-ethyl-N-n-hexylamino)-6-methyl-7-anilinofluoran, 3-hexamethyleneimino-6-methyl-7-anilinofluoran, 3-diethylamino-6-chloro-7-anilinofluoran, 3-diethylamino-6-bromo-7-anilinofluoran, 3-diethylamino-6-iodo-7-anilinofluoran, 3-diethylamino-1,6-dimethyl-7-anilinofluoran, 3-diethylamino-4-chloro-6-methyl-7-anilinofluoran, 3-diethylamino-7-(o-chloroanilino)fluoran, 3-dibutylamino-7-(o-chloroanilino)fluoran, 3-diethylamino-7-(o-bromoanilino)fluoran, 3-dibutylamino-7-(o-fluoranilino)fluoran, 3-diethylamino-7-(o-methoxycarbonylphenylamino)fluoran, 3-diethylamino-5,6-dimethyl-7-anilinofluoran, 3-diethylamino-5-chloro-6-methyl-7-anilinofluoran, 3-dibutylamino-6-methyl-7-(p-chloroanilino)fluoran, 3-diethylamino-7-(m-trifluoromethylanilino)fluoran, 3-dibutylamino-7-(p-trifluoromethylanilino)fluoran, 3-diethylamino-5-methyl-7-(m-trifluoromethylanilino)fluoran, 3-diethylamino-5-ethyl-7-(m-trifluoromethylanilino)fluoran, 3-diethylamino-5-chloro-7-(m-trifluoromethylanilino)fluoran, 3-(N-ethyl-N-ethoxypropylamino)-6-methyl-7-anilinofluoran, 3-(N-ethyl-N-tetrahydrofurfuryl)-6-methyl-7-anilinofluoran, 3-(N-methyl-N-tetrahydrofurfuryl)-6-methyl-7-anilinofluoran, etc.

Among the above various black color-forming fluoran derivatives, especially the following derivatives having basic skeletons of the formula [III], [IV] or [V] are preferably used, since they achieve excellent effects of the invention more efficiently.

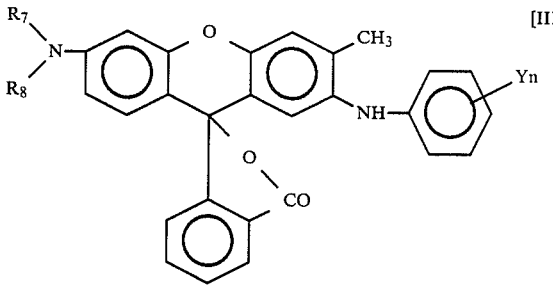

[III]

wherein $R_7$, $R_8$ and n are same as above, Y is hydrogen atom; $C_{1\sim4}$ alkyl; $C_{1\sim4}$ alkoxyl; halogen atom; or di($C_{1\sim4}$ alkyl)amino,

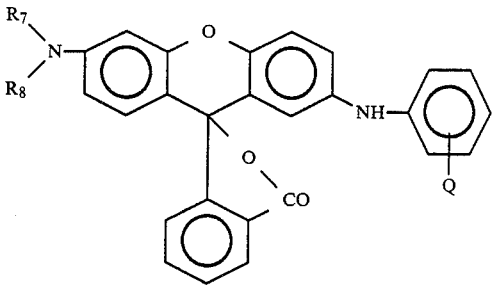

[IV]

wherein $R_7$ and $R_8$ are same as above, Q is halogen atom; halogenated $C_{1\sim4}$ alkyl; or ($C_{1\sim4}$ alkoxy)carbonyl,

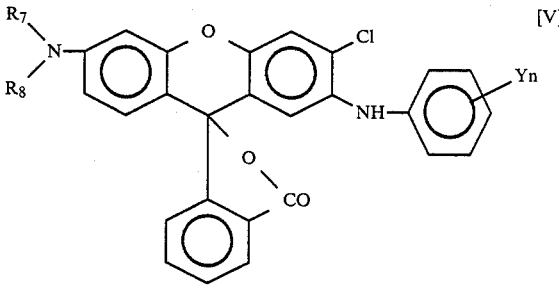

[V]

wherein $R_7$, $R_8$, Y and n are as defined above.

These black color-forming fluoran derivatives can be used singly or in mixture. In case the fluoran derivative is used in an amount of less than 20 parts by weight per 100 parts by weight of the phthalide derivative of the formula [I], the resulting heat-sensitive recording material forms images which insufficiently color in black and therefore poor in commercial value. However, with more than 100 parts by weight of the fluoran derivative, the heat-sensitive recording material forms images having PCS value of less than 0.75 which cause misreading with optical character-reading device over the infrared region.

Therefore, it is necessary to employ the above black color-forming fluoran derivative of the formula [II] in an amount of 20 to 100 parts by weight per 100 patrts by weight of the above phthalide derivative of the formula [I].

In the present heat-sensitive recording material, various basic dyes as shown below can be, as required, used conjointly with the above basic dyes of the formulae [I] and [II].

Triarylmethane lactones, e.g., 3,3-bis(p-dimethylaminophenyl)-6-dimethylaminophthalide, 3-(p-dibenzylaminophenyl)-3-(1,2-dimethylindole-3-yl)-7-azaphthalide, 3-(4-diethylamino-2-ethoxyphenyl)-3-(1-ethyl-2-methylindole-3-yl)-7-azaphthalide, 3,3-bis(1-ethyl-2-methylindole-3-yl)phthalide, etc.

Fluorans, e.g., 3-diethylamino-6-methylfluoran, 3-diethylamino-6-methyl-7-chlorofluoran, 3-(N-ethyl-N-p-tolylamino)-7-methylfluoran, 3-diethylamino-7-anilinofluoran, 3-diethylamino-7-dibenzylaminofluoran, etc.

Spiropyrans, e.g., di-$\beta$-naphthospiropyran, 3-methyl-di-$\beta$-naphthospiropyran, etc.

In the present heat-sensitive recording material, a polyvalent metal salt of aromatic carboxylic acid is selectively used as a color acceptor which is reactive with the above specific basic dyes to form a color. Examples of useful aromatic carboxylic acids are monomethyl tetrachlorophthalate, monoethyl tetrachlorophthalate, monobenzyl tetrabromophthalate and like phthalic acid monoesters; m-toluic acid, anisic acid, 3-nitrobenzoic acid, 4-nibrobenzoic acid, 4-nitro-3-methyl-benzoic acid and like benzoic acids; 2-hydroxy-1-naphthoic acid, 1-hydroxy-2-naphthoic acid, 3-hydroxy-2-naphthoic acid and like naphthoic acids; 4-tert-butyl-salicylic acid, 3,5-di-$\alpha$-methylbenzylsalicylic acid and like salicylic acids; indolecarboxylic acids such as indole-2-carboxylic acid derivative of the formula [VI]; etc.

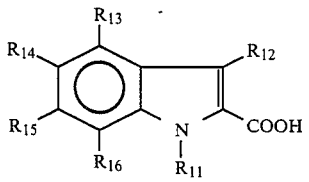

[VI]

wherein $R_{11}$ is hydrogen atom; $C_{1\sim8}$ alkyl unsubstituted or substituted with $C_{1\sim4}$ alkoxy; $C_{5\sim12}$ cycloalkyl unsubstituted or substituted with halogen atom or $C_{1\sim4}$ alkyl; allyl unsubstituted or substituted with $C_{1\sim4}$ alkyl or phenyl; propargyl unsubstituted or substituted with $C_{1\sim4}$ alkyl or phenyl; phenyl unsubstituted or substituted with halogen atom, $C_{1\sim4}$ alkyl or $C_{1\sim4}$ alkoxyl; $C_{7\sim9}$ aralkyl unsubstituted or substituted with halogen atom, $C_{1\sim4}$ alkyl or $C_{1\sim4}$ alkoxyl; ($C_{1\sim4}$ alkyl)carbonyl; or benzoyl unsubstituted or substituted with halogen atom, $C_{1\sim4}$ alkyl or $C_{1\sim4}$ alkoxyl, $R_{12}\sim R_{16}$ are each hydrogen atom; $C_{1\sim8}$ alkyl unsubstituted or substituted with $C_{1\sim4}$ alkoxyl or di($C_{1\sim4}$ alkyl)amino; allyl unsubstituted or substituted with $C_{1\sim4}$ alkyl or phenyl; propargyl unsubstituted or substituted with $C_{1\sim4}$ alkyl or phenyl; phenyl unsubstituted or substituted with halogen atom, hydroxyl, $C_{1\sim4}$ alkyl or $C_{1\sim4}$ alkyl; $C_{7\sim9}$ aralkyl unsubstituted or substituted with halogen atom, $C_{1\sim4}$ alkyl or $C_{1\sim4}$ alkoxyl; $C_{1\sim4}$ alkoxyl unsubstituted or substituted with phenyl or phenoxy; allyloxy unsubstituted or substituted with $C_{1\sim4}$ alkyl or phenyl; propargyloxy unsubstituted or substituted with $C_{1\sim4}$ alkyl or phenyl; phenoxy unsubstituted or substituted with halogen atom, $C_{1\sim4}$ alkyl or $C_{1\sim4}$ alkoxyl; $C_{7\sim9}$ aralkyloxy unsubstituted or substituted with halogen atom, $C_{1\sim4}$ alkyl or $C_{1\sim4}$ alkoxyl; ($C_{1\sim4}$ alkyl)carbonyloxy; benzoyloxy unsubstituted or substituted with halogen atom, $C_{1\sim4}$ alkyl or $C_{1\sim4}$ alkoxyl; ($C_{1\sim4}$ alkyl)-carbonyl; benzoyl unsubstituted or substituted with halogen atom, $C_{1\sim4}$ alkyl or $C_{1\sim4}$ alkoxyl; carbamoyl unsubstituted or substituted with $C_{1\sim4}$ alkyl or phenyl; amino unsubstituted or substituted with benzoyl, benzenesulfonyl, $C_{1\sim8}$ alkyl, phenyl, benzyl or ($C_{1\sim4}$ alkyl)carbonyl, benzoyl and benzenesulfonyl may be substituted with halogen atom, $C_{1\sim4}$ alkyl or $C_{1\sim4}$ alkoxyl; halogen atom; nitro; cyano; or hydroxyl.

Examples of useful indole-2-carboxylic acid derivatives of the formula [VI]are indole-2-carboxylic acid, 1-methylindole-2-carboxylic acid, 3-methylindole-2-carboxylic acid, 5-methylindole-2-carboxylic acid, 6-methylindole-2-carboxylic acid, 1,3-dimethylindole-2-carboxylic acid, 1,5-dimethylindole-2-carboxylic acid, 1-phenylindole-2-carboxylic acid, 3-phenylindole-2-carboxylic acid, 3-(2-hydroxyphenyl)indole-2-carboxylic acid, 1-benzylindole-2-carboxylic acid, 1-allylindole-2-carboxylic acid, 1-propargylindole-2-carboxylic acid, 1-acetylindole-2-carboxylic acid, 3-acetylindole-2-carboxylic acid, 1-benzoylindole-2-carboxylic acid, 3-benzoylindole-2-carboxylic acid, 5-methoxyindole-2-carboxylic acid, 5-ethoxyindole-2-carboxylic acid, 5-phenoxyindole-2-carboxylic acid, 5-(benzyloxy)indole-2-carboxylic acid, 5-(cyclohexyloxy)indole-2-carboxylic acid, 5-acetoxyindole-2-carboxylic acid, 5-(benzoyloxy)indole-2-carboxylic acid, 5-carbamoylindole-2-carboxylic acid, 5-chloroindole-2-carboxylic acid, 4-nitroindole-2-carboxylic acid, 5-nitroindole-2-carboxylic acid, 5-cyanoindole-2-carboxylic acid, 5-hydroxyindole-2-carboxylic acid, 5-(dimethylamino)indole-2-carboxylic acid, etc.

Examples of polyvalent metals which form a salt with the above various aromatic carboxylic acids are magnesium, calcium, barium, zinc, aluminum, tin, cobalt, nickel, etc. Among these metals are preferable magnesium, calcium, barium, zinc and aluminum. These polyvalent metal salts of aromatic carboxylic acids can be used singly or in mixture thereof.

Among these polyvalent metal salts of aromatic carboxylic acids, especially preferable are polyvalent metal salts of indolecarboxylic acid derivatives, particularly indole-2-carboxylic acid derivative of the formula [VI], since they not only enhance color forming ability of the phthalide derivative of the formula [I] more efficiently, but also form images which are excellent in resistances to light and plasticizer. Further, most preferable are polyvalent metal salts of indole-2-carboxylic acid derivatives of the formula [VII] which achieve more excellent improvement in color forming ability.

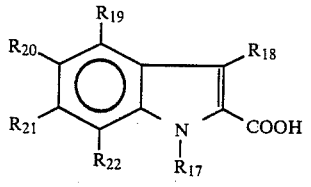

[VII]

wherein $R_{17}$ is hydrogen atom or $C_{1\sim4}$ alkyl, $R_{18}\sim R_{22}$ are each hydrogen atom; $C_{1\sim4}$ alkyl unsubstituted or substituted with di($C_{1\sim4}$ alkyl)amino; phenyl unsubstituted or substituted with hydroxyl; $C_{1\sim4}$ alkoxyl; phenoxy; benzyloxy; ($C_{1\sim4}$ alkyl)carbonyloxy; benzoyloxy; ($C_{1\sim4}$ alkyl)carbonyl; benzoyl; halogen atom; cyano; or hydroxyl.

Although the present heat-sensitive recording material is greatly characterized by using, as a color acceptor, the above polyvalent metal salt of aromatic carboxylic acid, various known color acceptors are conjointly usable such as bisphenol A, 4,4'-cyclohexylidenediphenol, dimethyl 4-hydroxyphthalate, etc.

As a recording sensitizer of the invention are used various known heat-fusible compounds such as caproic amide, enanthic amide, caprylic amide, pelargonic amide, capric amide, undecylic amide, lauramide, tridecylic amide, myristic amide, pentadecyclic amide, palmitic amide, heptadecylic amide, stearic amide, nonadecylic amide, arachic amide, linolenic amide, stearic anilide, stearic toluidide, stearic xylidide, caproic anilide, palmitic toluidide and like fatty acid amides; 2,2'-methylenebis(4-methyl-6-tert-butylphenol), 1,1,3-tris(2-methyl-4-hydroxy-5-tert-butylphenyl)butane and like hindered phenols; 1,2-bis(phenoxy)ethane, 1,2-bis(4-methylphenoxy)ethane, 1,2-bis(3-methylphenoxy)ethane, 2-naphthol benzyl ether and like ethers; dibenzyl terephthalate, phenyl 1-hydroxy-2-naphthoate and like esters; ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzyl m-hydroxybenzoate, methyl m-hydroxybenzoate and like hydroxybenzoic acid esters.

When a heat-fusible compound having a melting point of more than 140° C. is used as the recording sensitizer, color forming sensitivity is insufficiently enhanced. Whereas with a heat-fusible compound less than 70° C. in melting point, undesirable color formation is likely to occur in the recording layer. Thus, in the present invention, it is desirable to use a heat-fusible compound having a melting point of 70° to 140° C., preferably 80° to 130° C.

Among these recording sensitizers, especially preferable are fatty acid amides and hydroxybenzoic acid esters which have excellent effects in improving recording sensitivity. These recording sensitizer can be used singly or in mixture thereof.

The present heat-sensitive recording material will be explained in more detail below. Various kinds of heat-sensitive recording materials are disclosed, for example, in Japanese examined patent publication Nos. 3,680/1969, 27,880/1969, 14,039/1970, 43,830/1973, 69/1974, 70/1974, 20,142/1977, etc. The present invention can be applied to these various kinds of heat-sensitive recording materials, and provides the heat-sensitive recording material which gives the aforementioned excellent characteristics.

Generally, to a medium having dissolved or dispersed therein a binder were added fine particles of the basic dyes, the color acceptor and the recording sensitizer to obtain a coating composition. The composition is applied to a suitable substrate such as a paper, plastic film, synthetic paper, non-woven sheet, shaped article to prepare the present heat-sensitive recording material.

The proportions of the basic dye and the color acceptor in the recording layer are not limitative but are usually 1 to 50 parts by weight, preferably 2 to 10 parts by weight of the latter per one part by weight of the former. Further, the proportions of the basic dyes and the recording sensitizer are also not limitative but are usually 0.3 to 25 parts by weight, preferably 0.7 to 10 parts by weight of the latter per one part by weight of the former.

In order to improve color forming ability, take off the luster of the surface of the recording layer or enhance the writing ability, inorganic metal compound such as oxides, hydroxides or carbonates of polyvalent metals, or inorganic pigment is used conjointly in an amount of 0.1 to 10 parts by weight, preferably 0.5 to 3 parts by weight per one part by weight of the color acceptor. Further, as required, various auxiliary agents are usable such as a dispersing agent, ultraviolet ray absorbing agent, defoaming agent, fluorescent dye, coloring dye, etc.

As described above, the present heat-sensitive recording material is prepared by applying to a substrate a coating composition having dispersed therein fine particles of the basic dye, color acceptor and recording sensitizer. Alternatively, two coating compositions having dispersed the basic dye and color acceptor respectively are applied to a substrate one upon another. Further, the coating composition can be applied to a substrate by impregnation.

The method of preparing a coating composition and coating method are not particularly limited and the coating composition is applied in an amount of usually 2 to 12 g/m$^2$ based on dry weight. It is possible to form an overcoat layer on the recording layer in order to protect the recording layer or to form an under layer on a substrate. Further, various known techniques in the field of the heat-sensitive recording material are usable.

As a binder are used starches, celluloses, peptides, gum arabic, polyvinyl alcohol, styrene-maleic anhydride copolymer salt, styrene-butadiene copolymer emulsion, vinyl acetate-maleic anhydride copolymer salt, polyacrylic acid salt, etc. in an amount of 10 to 40% by weight, preferably 15 to 30% by weight based on a total solid of the coating composition.

EXAMPLES

The invention will be described below in more detail with reference to Examples without limiting the scope thereof. In the Examples, parts and percentages are all by weight, unless otherwise specified.

EXAMPLE 1

(1) Composition (A)

3-Dimethylamino-6-(N-methyl-N-tetrahydrofurfurylamino)fluorene-9-spiro-3'-(6'-dimethylamino)phthalide (10 parts), 5 parts of 5% aqueous solution of methyl cellulose and 40 parts of water were pulverized by a sand mill to prepare Composition (A) having an average particle size of 3 μm.

(2) Composition (B)

Zinc salt of indole-2-carboxylic acid (30 parts), 5 parts of 5% aqueous solution of methyl cellulose and 55 parts of water were pulverized by a sand mill to prepare Composition (B) having an average particle size of 3 μm.

(3) Composition (C)

Stearic amide (30 parts), 5 parts of 5% aqueous solution of methyl cellulose and 55 parts of water were pulverized by a sand mill to prepare Composition (C) having an average particle size of 3 μm.

(4) Composition (D)

3-(N-Cyclohexyl-N-methylamino)-6-methyl-7-anilinofluoran (5 parts), 5 parts of 5% aqueous solution of methyl cellulose and 40 parts of water were pulverized by a sand mill to prepare Composition (D) having an average particle size of 3 μm.

(5) Preparation of a recording layer

A 55-part quantity of Composition (A), 90 parts of Composition (B), 90 parts of Composition (C), 50 parts of Composition (D), 15 parts of silicon oxide pigment (oil adsorption 180 ml/100 g), 50 parts of 20% aqueous solution of oxidized starch and 10 parts of water were mixed with stirring to prepare a coating composition. The coating composition was applied to a paper substrate weighing 50 g/m$^2$ in an amount of 6 g/m$^2$ by dry weight to prepare a heat-sensitive recording paper.

EXAMPLE 2

A heat-sensitive recording paper was prepared in the same manner as in Example 1 except that the calcium salt of indole-2-carboxylic acid was used in place of zinc salt of indole-2-carboxylic acid.

EXAMPLE 3

A heat-sensitive recording paper was prepared in the same manner as in Example 1 except that magnesium salt of 4-tert-butylsalicylic acid was used in place of zinc salt of indole-2-carboxylic acid.

EXAMPLE 4

A heat-sensitive recording paper was prepared in the same manner as in Example 1 except that zinc salt of p-nitrobenzoic acid was used in place of zinc salt of indole-2-carboxylic acid.

EXAMPLE 5

A heat-sensitive recording paper was prepared in the same manner as in Example 1 except that zinc salt of monobutyl tetrachlorophthalate was used in place of zinc salt of indole-2-carboxylic acid.

EXAMPLE 6

A heat-sensitive recording paper was prepared in the same manner as in Example 1 except that benzyl p-hydroxybenzoate was used in place of stearic amide.

EXAMPLE 7

A heat-sensitive recording paper was prepared in the same manner as in Example 1 except that lauramide was used in place of stearic amide.

EXAMPLE 8

A heat-sensitive recording paper was prepared in the same manner as in Example 1 except that 3,6-bis-dimethylaminofluorene-9-spiro-3'-(6'-diemthylamino)phthalide was used in place of 3-dimethylamino-6-(N-methyl-N-tetrahydrofurfurylamino)fluorene-9-spiro-3'-(6'-dimethylamino)phthalide.

COMPARISON EXAMPLE 1

A heat-sensitive recording paper was prepared in the same manner as in Example 1 except that Composition (C) was not used in the preparation of the coating composition.

COMPARISON EXAMPLE 2

A heat-sensitive recording paper was prepared in the same manner as in Example 1 except that bisphenol A was used in place of zinc salt of indole-2-carboxylic acid.

COMPARISON EXAMPLE 3

A heat-sensitive recording paper was prepared in the same manner as in Example 1 except that benzyl p-hydroxybenzoate was used in place of zinc salt of indole-2-carboxylic acid.

EXAMPLES 9 TO 13 AND COMPARISON EXAMPLES 4 AND 5

Seven kinds of heat-sensitive recording papers were prepared in the same manner as in Example 1 with use of 3-(N-cyclohexyl-N-methylamino)-6-methyl-7-anilinofluoran in amounts listed in Table 2.

EXAMPLES 14 TO 18

Five kinds of heat-sensitive recording papers were prepared in the same manner as in Example 1 except that the following phthalide derivative and fluoran derivative were used in place of 3-dimethylamino-6-(N-methyl-N-tetrahydrofurfurylamino)fluorene-9-spiro-3'-(6'-dimethylamino)phthalide and 3-(N-cyclohexyl-N-methylamino)-6-methyl-7-anilinofluoran.

Example 14; 3-diethylamino-6-(N-methyl-N-allylamino)fluorene-9-spiro-3'-(6'-dimethylamino)phthalide and 3-(N-ethyl-N-isopentylamino)-6-methyl-7-anilinofluoran.

Example 15; 3-diethylamino-6-(N-ethyl-N-β-phenylethylamino)fluorene-9-spiro-3'-(6'-dimethylamino)phthalide and 3-diethylamino-6-methyl-7-anilinofluoran.

Example 16; 3-diethylamino-6-(N-ethyl-N-cyclopentylamino)fluorene-9-spiro-3'-(6'-dimethylamino)phthalide and 3-diethylamino-6-chloro-7-anilinofluoran.

Example 17; 3,6-bis(diethylamino)fluorene-9-spiro-3'-(6'-pyrrolidino)phthalide and 3-dibutylamino-7-o-chloroanilinofluoran.

Example 18; 3,6-bis(N-ethyl-N-ethoxyethylamino)fluorene-9-spiro-3'-(6'-diethylamino)phthalide and 3-(N-ethyl-N-ethoxypropylamino)-6-methyl-7-anilinofluoran.

EXAMPLES 19 TO 23

Five kinds of heat-sensitive recording papers were prepared in the same manner as in Example 1 except that the following polyvalent metal salts of indole-2-carboxylic acid derivatives were used in place of zinc salt of indole-2-carboxylic acid.

Example 19; zinc salt of 1-methylindole-2-carboxylic acid

Example 20; zinc salt of 3-phenylindole-2-carboxylic acid

Example 21; zinc salt of 5-methoxyindole-2-carboxylic acid

Example 22; zinc salt of 5-chloroindole-2-carboxylic acid

Example 23; magnesium salt of 5-acetoxyindole-2-carboxylic acid

The obtained twenty eight kinds of the heat-sensitive recording papers were checked for quality and the results were given in Tables 1 to 4.

1 Color forming ability over the near infrared region

The record images printed by use of a heat-sensitive recording printer (Texas Instruments Inc., Model PC-100A) were checked for PCS value at 800 nm.

2 Light resistance over the near infrared region

The recording paper obtained after tested in the above color forming ability was directly exposed to sunlight for 16 hours. Thereafter PCS value was again measured.

PCS value is calculated by the following equation.

$$PCS \text{ value} = \frac{A - B}{A}$$

A; reflectivity of the background area before recording
B; reflectivity of the recorded area after recording As apparent from the results in Tables 1 to 4, the present heat-sensitive recording material can be applied to optical character-reading device having a reading wavelength range over the infrared region, and is excellent in color forming ability. The present recording material gives record images which have excellent resistance to light and do not fade by the irradiation of light for a long period of time, and is extremely high in commercial value.

TABLE 1

| | | Color forming ability | Resistance to light |
|---|---|---|---|
| Example | 1 | 0.84 | 0.83 |
| | 2 | 0.83 | 0.81 |
| | 3 | 0.78 | 0.76 |
| | 4 | 0.76 | 0.71 |
| | 5 | 0.79 | 0.75 |
| | 6 | 0.84 | 0.82 |
| | 7 | 0.84 | 0.83 |
| | 8 | 0.85 | 0.84 |
| Com. Ex. | 1 | 0.30 | 0.25 |
| | 2 | 0.53 | 0.19 |
| | 3 | 0.49 | 0.20 |

TABLE 2

| | | Amount of dye(*) | Record color | Color forming ability | Resistance to light |
|---|---|---|---|---|---|
| Com. Ex. | 4 | 1 | Blue | 0.90 | 0.90 |
| Ex. | 9 | 2 | Bluish black | 0.88 | 0.88 |
| | 10 | 3 | Black | 0.86 | 0.85 |
| | 11 | 5 | Black | 0.84 | 0.83 |
| | 12 | 8 | Black | 0.80 | 0.78 |
| | 13 | 10 | Black | 0.77 | 0.75 |
| Com. Ex. | 5 | 12 | Black | 0.73 | 0.71 |

(*)Amount (parts) of 3-(N—cyclohexyl-N—methylamino)-6-methyl-7-anilinofluoran

TABLE 3

| | | Color forming ability | Resistance to light |
|---|---|---|---|
| Example | 14 | 0.85 | 0.84 |
| | 15 | 0.84 | 0.82 |
| | 16 | 0.85 | 0.84 |
| | 17 | 0.83 | 0.81 |

TABLE 3-continued

| | | Color forming ability | Resistance to light |
|---|---|---|---|
| | 18 | 0.84 | 0.82 |

TABLE 4

| | | Color forming ability | Resistance to light |
|---|---|---|---|
| Example | 19 | 0.85 | 0.83 |
| | 20 | 0.83 | 0.82 |
| | 21 | 0.84 | 0.83 |
| | 22 | 0.85 | 0.83 |
| | 23 | 0.83 | 0.81 |

We claim:

1. In a heat-sensitive recording material incorporating a substrate, a colorless or pale-colored basic dye and a color acceptor which is reactive with the dye to form a color when contacted therewith, the recording material characterized in that (a) as the basic dye are used 100 parts by weight of a phthalide derivative of the formula (I) and 20 to 100 parts by weight of a black color-forming fluoran derivative of the formula (II), (b) as the color acceptor is used a polyvalent metal salt of an aromatic caboxylic acid and (c) a heat-fusible recording sensitizer having a melting point of 70° to 140° C. is further used, and whereby the resulting record images are at least 0.75 in PCS value at 800 nm

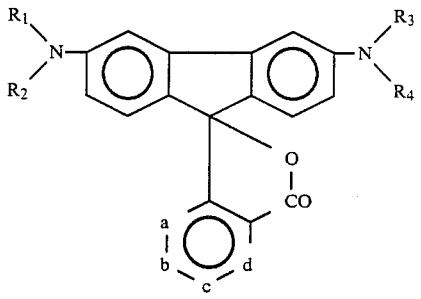

[I]

wherein $R_1$ to $R_4$ are each hydrogen atom; $C_{1\sim8}$ alkyl; $C_{5\sim8}$ cycloalkyl; $C_{3\sim9}$ unsaturated alkyl; tetrahydrofurfuryl; tetrahydropyran-2-methyl; $C_{7\sim10}$ aralkyl unsubstituted or substituted with halogen atom, $C_{1\sim4}$ alkyl or $C_{1-4}$ alkoxyl; phenyl unsubstituted or substituted with halogen atom, $C_{1\sim4}$ alkyl or $C_{1\sim4}$ alkoxyl; $C_{2\sim8}$ alkyl having phenoxy unsubstituted or substituted with halogen atom, $C_{1\sim4}$ alkyl or $C_{1\sim4}$ alkoxyl; or halogenated $C_{1\sim8}$ alkyl; $R_1$ and $R_2$, and/or $R_3$ and $R_4$ may form a heteroring selected from the group consisting of pyrrolidine, piperidine, hexamethyleneimine, morpholine, julolidine and tetrahydroquinoline together therewith or with an adjacent benzene ring, a, b, c and d represent carbon atoms and one or two of them may be nitrogen atom, the carbon atom may have a substituent selected from the group consisting of hydrogen atom; halogen atom; $C_{1\sim4}$ alkyl; $C_{1\sim4}$ alkoxyl; —N($R_5$)($R_6$), $R_5$ and $R_6$ are same as $R_1$ to $R_4$; and nitro, one of a—b, b—c and c—d bond may form an another benzene ring together with the substituent,

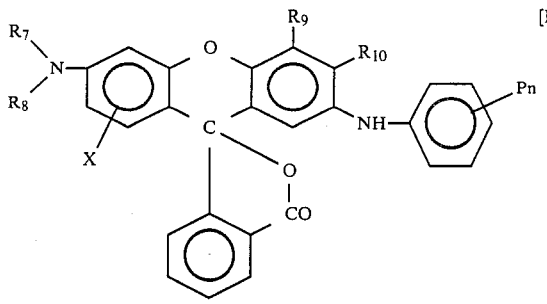

[II]

wherein $R_7$ and $R_8$ are each $C_{1\sim8}$ alkyl unsubstituted or substituted with halogen atom or $C_{1\sim4}$ alkoxyl; unsaturated $C_{3\sim9}$ alkyl; $C_{5\sim12}$ alicyclic group; phenyl unsubstituted or substituted with halogen atom, $C_{1\sim4}$ alkyl or $C_{1\sim4}$ alkoxyl; benzyl unsubstituted or substituted with halogen atom, $C_{1\sim4}$ alkyl or $C_{1\sim4}$ alkoxyl; or tetrahydrofurfuryl, $R_7$ and $R_8$ may form a ring selected from the group consisting of pyrrolidine, piperidine, hexamethyleneimine and morpholine together therewith, $R_9$ and $R_{10}$ are each hydrogen atom; halogen atom; $C_{1\sim4}$ alkyl; or $C_{1\sim4}$ alkoxyl, P is hydrogen atom; halogen atom; $C_{1\sim4}$ alkyl; $C_{5-6}$ alicyclic group; halogenated $C_{1\sim4}$ alkyl; phenyl; benzyl; $C_{1\sim4}$ alkoxyl; ($C_{1\sim4}$ alkoxy)carbonyl; or di($C_{1\sim4}$ alkyl)amino, X is hydrogen atom; halogen atom; or $C_{1\sim4}$ alkyl, n is an integer of 1 to 4.

2. A heat-sensitive recording material as defined in claim 1 wherein the black color-forming fluoran derivative is a compound of the formula [III]

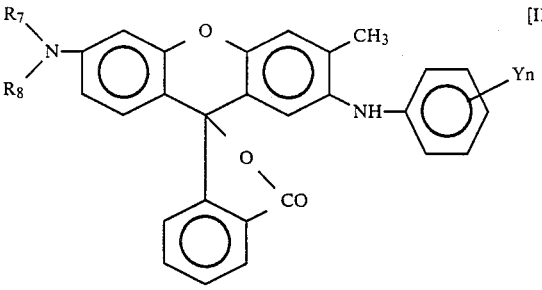

[III]

wherein $R_7$, $R_8$ and n are same as above, Y is hydrogen atom; $C_{1\sim4}$ alkyl; $C_{1\sim4}$ alkoxyl; halogen atom; or di($C_{1\sim4}$)alkylamino.

3. A heat-sensitive recording material as defined in claim 1 wherein the black color-forming fluoran derivative is a compound of the formula [IV]

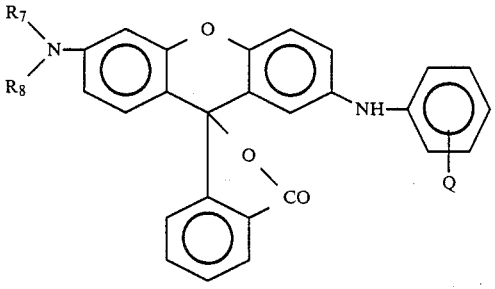

[IV]

wherein $R_7$ and $R_8$ are same as above, Q is halogen atom; halogenated $C_{1\sim4}$ alkyl; or ($C_{1\sim4}$ alkoxy)carbonyl.

4. A heat-sensitive recording material as defined in claim 1 wherein the black color-forming fluoran derivative is a compound of the formula [V]

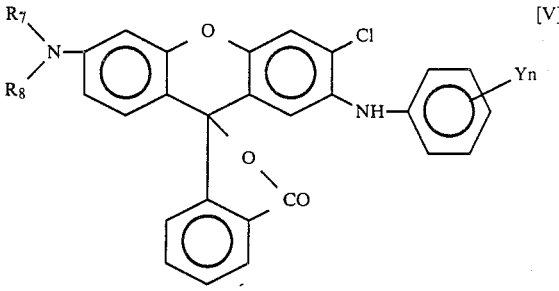

[V]

wherein $R_7$, $R_8$, Y and n are as defined above.

5. A heat-sensitive recording material as defined in claim 1 wherein the aromatic carboxylic acid is at least one compound selected from the group consisting of phthalic acid monoesters, benzoic acids, naphthoic acids, salicylic acids and indolecarboxylic acids.

6. A heat-sensitive recording material as defined in claim 1 wherein the aromatic carboxylic acid is at least one compound selected from the group consisting of indolecarboxylic acids.

7. A heat-sensitive recording material as defined in claim 6 wherein the indolecarboxylic acid is an indole-2-carboxylic acid derivative of the formula [VI]

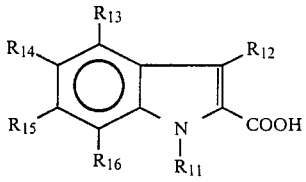

[VI]

wherein $R_{11}$ is hydrogen atom; $C_{1\sim8}$ alkyl unsubstituted or substituted with $C_{1\sim4}$ alkoxyl; $C_{5\sim12}$ cycloalkyl unsubstituted or substituted with halogen atom or $C_{1-4}$ alkyl; allyl unsubstituted or substituted with $C_{1\sim4}$ alkyl or phenyl; propargyl unsubstituted or substituted with $C_{1\sim4}$ alkyl or phenyl; phenyl unsubstituted or substituted with halogen atom, $C_{1-4}$ alkyl or $C_{1-4}$ alkoxyl; $C_{7\sim9}$ aralkyl unsubstituted or substituted with halogen atom, $C_{1\sim4}$ alkyl or $C_{1\sim4}$ alkoxyl; ($C_{1\sim4}$ alkyl)carbonyl; or benzoyl unsubstituted or substituted with halogen atom, $C_{1\sim4}$ alkyl or $C_{1\sim4}$ alkoxyl, $R_{12}\sim R_{16}$ are each hydrogen atom; $C_{1\sim8}$ alkyl unsubstituted or substituted with $C_{1\sim4}$ alkoxyl or di($C_{1\sim4}$ alkyl)amino; allyl unsubstituted or substituted with $C_{1\sim4}$ alkyl or phenyl; propargyl unsubstituted or substituted with $C_{1\sim4}$ alkyl or phenyl; phenyl unsubstituted or substituted with halogen atom, hydroxyl, $C_{1\sim4}$ or $C_{1\sim4}$ alkoxyl; $C_{7\sim9}$ aralkyl unsubstituted or substituted with halogen atom, $C_{1\sim4}$ alkyl or $C_{1\sim4}$ alkoxyl; $C_{1\sim4}$ alkoxyl unsubstituted or substituted with phenyl or phenoxy; allyloxy unsubstituted or substituted with $C_{1\sim4}$ alkyl or phenyl; propargyloxy unsubstituted or substituted with $C_{1\sim4}$ alkyl or phenyl; phenoxy unsubstituted or substituted with halogen atom, $C_{1\sim4}$ alkyl or $C_{1\sim4}$ alkoxyl; $C_{7\sim9}$ aralkyloxy unsubstituted or substituted with halogen atom, $C_{1\sim4}$ alkyl or $C_{1\sim4}$ alkoxyl; ($C_{1\sim4}$ alkyl)carbonyloxy;

benzoyloxy unsubstituted or substituted with halogen atom, $C_{1\sim4}$ alkyl or $C_{1\sim4}$ alkoxyl; ($C_{1\sim4}$ alkyl)carbonyl; benzoyl unsubstituted or substituted with halogen atom, $C_{1\sim4}$ alkyl or $C_{1\sim4}$ alkoxyl; carbamoyl unsubstituted or substituted with $C_{1\sim4}$ alkyl or phenyl; amino unsubstituted or substituted with benzoyl, benzenesulfonyl, $C_{1\sim8}$ alkyl, phenyl, benzyl or ($C_{1\sim4}$ alkyl)carbonyl, benzoyl and benzenesulfonyl may be substituted with halogen atom, $C_{1\sim4}$ alkyl or $C_{1\sim4}$ alkoxyl; halogen atom; nitro; cyano; or hydroxyl.

8. A heat-sensitive recording material as defined in claim 1 wherein the polyvalent metal salt is a salt of magnesium, calcium, barium, zinc, aluminum, tin, cobalt or nickel.

9. A heat-sensitive recording material as defined in claim 1 wherein the heat-fusible compound is a fatty acid amide derivative.

10. A heat-sensitive recording material as defined in claim 1 wherein the heat-fusible compound is a hydroxybenzoic acid ester.

* * * * *